US007452035B2

(12) United States Patent
Astle et al.

(10) Patent No.: US 7,452,035 B2
(45) Date of Patent: Nov. 18, 2008

(54) CHAIR

(75) Inventors: Robert A. Astle, Farmington, UT (US); Martin Neunzert, Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/980,950

(22) Filed: Nov. 3, 2004

(65) Prior Publication Data

US 2005/0104421 A1 May 19, 2005

Related U.S. Application Data

(63) Continuation-in-part of application No. 29/181,922, filed on May 16, 2003.

(60) Provisional application No. 60/516,775, filed on Nov. 3, 2003.

(51) Int. Cl.
*A47C 7/00* (2006.01)
*A47C 7/02* (2006.01)

(52) U.S. Cl. ..... 297/440.22; 297/183.7; 297/452.18

(58) Field of Classification Search ..... 297/183.7, 297/183.1, 452.19, 452.2, 446.1, 239, 183.9, 297/452.65, 452.14, 452.13, 440.22
See application file for complete search history.

(56) References Cited

U.S. PATENT DOCUMENTS

| | | | | |
|---|---|---|---|---|
| 2,207,338 | A | 7/1940 | Clarin | |
| 2,666,478 | A | 1/1954 | Shwayder | |
| D181,241 | S | 10/1957 | Swanson | |
| 2,843,391 | A | 7/1958 | Pelletier | |
| 2,865,437 | A | 12/1958 | Shwayder | |
| D186,658 | S | 11/1959 | Spilman | |
| 3,021,175 | A | 2/1962 | Norquist | |
| 3,094,357 | A | 6/1963 | Shwayder | |
| 3,111,344 | A | 11/1963 | Hoven et al. | |
| 3,146,028 | A | 8/1964 | Grosfillex | |
| 3,159,428 | A * | 12/1964 | Schier | 297/239 |
| 3,275,371 | A * | 9/1966 | Rowland | 297/239 |

(Continued)

OTHER PUBLICATIONS

National Business Furniture, p. 119, chair at bottom right.

(Continued)

*Primary Examiner*—Sarah B McPartlin
(74) *Attorney, Agent, or Firm*—Workman Nydegger

(57) ABSTRACT

A chair including a backrest and a chair seat is disclosed. The back rest and the chair seat are preferably constructed from blow-molded plastic and an opening or hole may be disposed through a portion of the chair. The opening is preferably formed in the backrest and the opening may extend completely through the backrest. Advantageously, the opening may form at least a portion of a handle and the opening may be formed during the blow-molding process. The chair may also include a frame and one or more legs that support the chair seat and backrest above a surface such as the floor or ground. In addition, the chair may include a first groove formed in the lower portion of the chair seat and a second groove formed in the lower portion of the chair seat, and a first crossbar may be at least partially disposed within the first groove and a second crossbar may be at least partially disposed within the second groove. The crossbars and/or grooves may be sized and configured to increase the strength and/or rigidity of the chair seat.

15 Claims, 8 Drawing Sheets

U.S. PATENT DOCUMENTS

| | | | | | |
|---|---|---|---|---|---|
| D214,834 | S | | 8/1969 | Moore et al. | |
| 3,466,084 | A | | 9/1969 | Moore et al. | |
| D215,836 | S | | 11/1969 | Bell, Jr. et al. | |
| 3,669,496 | A | * | 6/1972 | Chisholm | 297/448.1 |
| 3,751,109 | A | * | 8/1973 | Dufton | 297/445.1 |
| 3,944,280 | A | | 3/1976 | Keeler | |
| 4,035,019 | A | | 7/1977 | Gabourie | |
| 4,057,288 | A | | 11/1977 | Schwartz et al. | |
| 4,168,669 | A | | 9/1979 | Arnoff | |
| 4,240,663 | A | | 12/1980 | Locher | |
| 4,290,645 | A | | 9/1981 | Glickman et al. | |
| 4,304,436 | A | | 12/1981 | Rowland | |
| 4,305,617 | A | | 12/1981 | Benoit | |
| D264,405 | S | | 5/1982 | Adkinson | |
| 4,341,419 | A | | 7/1982 | Sebel | |
| 4,366,980 | A | | 1/1983 | Rowland | |
| D269,831 | S | | 7/1983 | Crone | |
| 4,400,031 | A | | 8/1983 | DeDecker | |
| 4,418,958 | A | | 12/1983 | Watkin | |
| D272,587 | S | | 2/1984 | Pamberg | |
| D274,392 | S | | 6/1984 | Blodee | |
| 4,456,296 | A | | 6/1984 | Rowland | |
| D275,244 | S | | 8/1984 | Snodgrass | |
| 4,522,444 | A | | 6/1985 | Pollock | |
| 4,548,441 | A | | 10/1985 | Ogg | |
| 4,655,504 | A | | 4/1987 | Weber | |
| D290,070 | S | | 6/1987 | Lange | |
| 4,674,795 | A | | 6/1987 | Nelson | |
| 4,676,552 | A | | 6/1987 | Hiller | |
| D295,588 | S | | 5/1988 | Heitlinger et al. | |
| 4,749,232 | A | | 6/1988 | Guichon | |
| D298,492 | S | | 11/1988 | Ochsner | |
| 4,807,929 | A | | 2/1989 | Balsbaugh | |
| D300,885 | S | | 5/1989 | Ochsner | |
| 4,913,496 | A | | 4/1990 | Oke | |
| D308,305 | S | | 6/1990 | Snodgrass | |
| D312,005 | S | | 11/1990 | Snodgrass | |
| 4,978,168 | A | | 12/1990 | Piretti | |
| 5,002,337 | A | | 3/1991 | Engel et al. | |
| D318,959 | S | | 8/1991 | Fink | |
| 5,039,163 | A | * | 8/1991 | Tolleson | 297/297 |
| 5,050,933 | A | | 9/1991 | Tornero et al. | |
| 5,064,247 | A | | 11/1991 | Clark et al. | |
| D323,079 | S | | 1/1992 | Hubert | |
| 5,088,792 | A | | 2/1992 | Guichon | |
| 5,110,186 | A | | 5/1992 | Clark et al. | |
| 5,123,702 | A | | 6/1992 | Caruso | |
| 5,154,474 | A | | 10/1992 | Desanta | |
| D333,733 | S | | 3/1993 | Sammons | |
| 5,201,108 | A | | 4/1993 | Clark et al. | |
| D338,785 | S | | 8/1993 | Lange | |
| D340,812 | S | | 11/1993 | Estomin et al. | |
| D344,418 | S | | 2/1994 | Favaretto | |
| D346,501 | S | | 5/1994 | Llusca | |
| 5,308,146 | A | | 5/1994 | Chou | |
| 5,383,712 | A | | 1/1995 | Perry | |
| D360,769 | S | | 8/1995 | Groulx et al. | |
| D362,558 | S | | 9/1995 | Reinhard | |
| D364,973 | S | | 12/1995 | de Reuver | |
| D367,185 | S | | 2/1996 | Olson | |
| 5,524,963 | A | | 6/1996 | Barile | |
| 5,524,966 | A | | 6/1996 | Piretti | |
| D372,596 | S | | 8/1996 | Reinhard | |
| D374,129 | S | | 10/1996 | Timmons | |
| D374,561 | S | | 10/1996 | Meijer | |
| D376,485 | S | | 12/1996 | Cretcher | |
| D376,702 | S | | 12/1996 | Cretcher | |
| 5,599,068 | A | | 2/1997 | Kelley et al. | |
| D378,553 | S | | 3/1997 | Newhouse | |
| 5,626,394 | A | | 5/1997 | Perry | |
| 5,632,524 | A | | 5/1997 | Ikeda et al. | |
| D382,415 | S | | 8/1997 | Leib | |
| D389,329 | S | | 1/1998 | Krause et al. | |
| D390,024 | S | | 2/1998 | DeJule | |
| D391,412 | S | | 3/1998 | James et al. | |
| D393,757 | S | | 4/1998 | Breen | |
| 5,738,408 | A | | 4/1998 | Wu | |
| D393,955 | S | | 5/1998 | Piretti | |
| 5,762,396 | A | | 6/1998 | Barile | |
| D396,563 | S | | 8/1998 | Meijer | |
| D397,880 | S | | 9/1998 | Saul | |
| D398,457 | S | | 9/1998 | Maly | |
| 5,803,540 | A | | 9/1998 | Schwartz | |
| 5,813,722 | A | | 9/1998 | Smith | |
| D400,023 | S | | 10/1998 | Olson | |
| 5,845,970 | A | | 12/1998 | Schwartz | |
| 5,860,697 | A | | 1/1999 | Fewchuck | |
| 5,863,096 | A | | 1/1999 | Bartlmae | |
| D405,285 | S | | 2/1999 | Balderi et al. | |
| D405,286 | S | | 2/1999 | James et al. | |
| D406,196 | S | | 3/1999 | Lyons | |
| D409,405 | S | | 5/1999 | Schultz et al. | |
| D409,408 | S | | 5/1999 | James et al. | |
| D409,848 | S | | 5/1999 | Staubach et al. | |
| D410,802 | S | | 6/1999 | Olson | |
| D411,694 | S | | 6/1999 | Bartlmae | |
| D411,777 | S | | 7/1999 | Schultz et al. | |
| 5,924,770 | A | * | 7/1999 | Tarnay et al. | 297/440.15 |
| D412,409 | S | | 8/1999 | Van Rhienen | |
| D413,450 | S | | 9/1999 | Van Rhienen | |
| D413,453 | S | | 9/1999 | Van Rhienen | |
| D414,052 | S | | 9/1999 | Van Rhienen | |
| RE36,335 | E | | 10/1999 | Perry | |
| D414,953 | S | | 10/1999 | Goetz | |
| D415,626 | S | | 10/1999 | Van Rhienen | |
| D416,700 | S | | 11/1999 | Van Rhienen | |
| D417,968 | S | | 12/1999 | Van Rhienen | |
| D417,970 | S | | 12/1999 | Duffy et al. | |
| 5,997,084 | A | | 12/1999 | Barile, Jr. et al. | |
| 5,997,094 | A | | 12/1999 | Cvek | |
| D418,319 | S | | 1/2000 | Van Rhienen | |
| D418,323 | S | | 1/2000 | Van Rhienen | |
| D419,321 | S | | 1/2000 | Rhienen | |
| D419,325 | S | | 1/2000 | Van Rhienen | |
| D420,522 | S | | 2/2000 | Rhienen | |
| D421,344 | S | | 3/2000 | Kaiser | |
| D422,805 | S | | 4/2000 | Smith | |
| D423,805 | S | | 5/2000 | Olson | |
| D423,807 | S | | 5/2000 | Bartlmae | |
| D429,423 | S | | 8/2000 | Van Rhienen | |
| D429,911 | S | | 8/2000 | Bartlmae | |
| 6,106,061 | A | | 8/2000 | Caruso et al. | |
| D430,415 | S | | 9/2000 | Schultz | |
| D432,326 | S | | 10/2000 | Duffy et al. | |
| 6,131,992 | A | | 10/2000 | Chang | |
| D433,576 | S | | 11/2000 | Hutton | |
| D433,578 | S | | 11/2000 | Saul | |
| D433,836 | S | | 11/2000 | Barile, Sr. | |
| D435,176 | S | | 12/2000 | Turner et al. | |
| D436,751 | S | | 1/2001 | Schacht | |
| 6,174,029 | B1 | | 1/2001 | Swy | |
| 6,234,571 | B1 | * | 5/2001 | Atkins et al. | 297/16.1 |
| D443,429 | S | | 6/2001 | Mower et al. | |
| D447,643 | S | | 9/2001 | Zemp | |
| D449,459 | S | | 10/2001 | Diez Mintegi | |
| 6,345,863 | B1 | | 2/2002 | Laws et al. | |
| D464,208 | S | * | 10/2002 | Kwon | D6/373 |
| D465,665 | S | | 11/2002 | Ritchie et al. | |
| D465,940 | S | | 11/2002 | Nien | |
| D466,712 | S | | 12/2002 | Haney et al. | |
| D468,921 | S | | 1/2003 | Kagan | |
| D470,670 | S | | 2/2003 | Meyer | |
| D472,745 | S | | 4/2003 | Haney et al. | |
| D477,470 | S | | 7/2003 | Haney et al. | |

| | | | | |
|---|---|---|---|---|
| D477,926 | S | 8/2003 | Haney et al. | |
| D477,939 | S | 8/2003 | Haney et al. | |
| 6,634,717 | B2 | 10/2003 | Kown | |
| D481,550 | S | 11/2003 | Astle | |
| D482,540 | S | 11/2003 | Ashby | |
| 6,644,751 | B2 * | 11/2003 | Ratza et al. | 297/452.52 |
| 6,679,558 | B2 * | 1/2004 | Adams et al. | 297/452.65 |
| 6,715,838 | B1 * | 4/2004 | Pflaster et al. | 297/452.2 |
| D489,192 | S | 5/2004 | Jin et al. | |
| D498,071 | S | 11/2004 | Ashby et al. | |
| 6,871,906 | B2 | 3/2005 | Haney | |
| D507,425 | S | 7/2005 | Ashby et al. | |
| D508,339 | S | 8/2005 | Astle | |
| 7,014,261 | B2 | 3/2006 | Haney | |
| 7,017,986 | B2 | 3/2006 | Degen et al. | |
| D519,292 | S | 4/2006 | Ashby | |
| D523,254 | S | 6/2006 | Nye et al. | |
| 2004/0034963 | A1 * | 2/2004 | Rogers et al. | 15/415.1 |

OTHER PUBLICATIONS

DPC Daniel Paul Chairs, 18 pages, Copyright 2004.

* cited by examiner

CHAIR

CROSS-REFERENCE TO RELATED APPLICATIONS

This application claims priority to and the benefit of U.S. Provisional Patent Application Ser. No. 60/516,775, entitled CHAIR, which was filed on Nov. 3, 2003, and is hereby incorporated by reference in its entirety.

This application is also a continuation-in-part of U.S. patent application Ser. No. 29/181,922, entitled CHAIR, which was filed on May 16, 2003, and is hereby incorporated by reference in its entirety.

BACKGROUND OF THE INVENTION

1. Field of the Invention

The present invention generally relates to furniture and, more particularly, to chairs constructed from blow-molded plastic.

2. Description of Related Art

Various types of tables and chairs are well known. In particular, it is well known to use tables and chairs at home, in the office, outdoors, in recreational settings and in other various locations. While tables and chairs are typically designed for use in a particular environment, various types of tables and chairs can often be used in other environments if desired.

Tables and chairs that are intended to be used outdoors, for example, are often made of materials that are designed to withstand the weather such as rain, snow, sleet and sunshine. Thus, many tables and chairs that are designed to be used outdoors are constructed from materials such as wood, metal and concrete. Tables and chairs constructed from these materials are often durable and long lasting. Disadvantageously, tables and chairs constructed from wood, metal or concrete are often very heavy and difficult to move. Thus, these types of tables and chairs are often not readily portable. In addition, tables and chairs constructed from these materials often require periodic maintenance and repair. For example, tables and chairs constructed from wood must be periodically painted or stained in order to protect the wood from damage.

It is also known to construct tables and chair from plastic, which may allow the weight of the tables and chairs to be decreased. Table and chairs that are relatively lightweight are generally easier to move, carry and transport than tables and chair that are heavier. Conventional tables and chairs constructed from plastic, however, often do not include a handle. Thus, while the tables and chairs may be relatively lightweight, the tables and chairs may still be difficult to carry and easily transport.

Conventional tables and chairs constructed from lightweight materials often undesirably flex or bend. For example, if a load or force is applied to conventional lightweight tables or chairs, the tables or chairs may flex or bend an excessive amount. This may create a table or chair that is unsteady and may not be able to support a relatively large load or weight, which may limit the usefulness of the table or chair. In addition, if the table or chair flexes or bends an excessive amount, then that may allow the frame or other portions of the table or chair to bend or break, which may lead to failure of the table or chair.

BRIEF SUMMARY OF THE INVENTION

A need therefore exists for chairs that reduce or eliminate the above-described disadvantages and problems.

One aspect is a chair that is constructed at least in part from plastic. For example, the chair seat and/or back rest may be constructed from plastic. The chair seat and back rest may be connected by a frame and the frame may be attached to or include legs that support the chair seat and back rest at the desired height. In addition, the chair seat and back rest may be constructed from plastic and the chair seat and back rest may be connected. Further, both the chair seat and back rest may be constructed from plastic and be integrally formed as part of a one-piece structure. It will be appreciated that any suitable portion of the chair may be constructed from plastic, and other portions of the chair may be constructed from other materials with appropriate characteristics.

Another aspect is a chair that is constructed at least in part from blow-molded plastic. For example, the chair seat, back rest, and/or the entire chair may be constructed from blow-molded plastic. It will be understood that while any suitable portions of the chair may be constructed from blow-molded plastic, other portions of the chair may be constructed from other types of materials, processes and methods. Thus, for example, one or more portions of the chair may be constructed from blow-molded plastic and other portions of the chair may be constructed from other materials and/or other processes.

Significantly, chairs including one or more components constructed from blow-molded plastic may be quickly and efficiently manufactured. Chairs constructed from blow-molded plastic may also be formed into many different desired shapes and sizes. Advantageously, the blow-molded plastic chairs may be durable, lightweight, easily manufactured and strong. In addition, if desired, all or a portion of the blow-molded plastic may be filled with materials such as expanded polymeric materials, including expanded polystyrene, expanded urethane and the like. Further, as discussed above, other portions of the chair may be constructed from other materials or processes. For example, while the chair seat and/or back rest may be constructed from blow-molded plastic, it may be desirable to construct one or more portions of the chair from other materials, such as plastic, or other methods or processes such as vacuum molding, injection molding, tumble molding and the like.

Chairs constructed at least in part from blow-molded plastic may be lightweight and easily portable. Advantageously, this may allow the chairs to be used in a wide variety of situations and environments. This also increases the potential uses of the chairs and allows the chairs to be used for a number of different purposes. In addition, because the chairs may be lightweight, the chairs may be rapidly and easily moved from one location to another. Further, the chairs may be moved in groups because of their lightweight. Finally, the lightweight chairs may be easily stacked and stored.

A further aspect is a chair that may be constructed from blow-molded plastic and the blow-molded plastic portion of the chair may include an opening. The opening desirably extends through the blow-molded plastic portion of the chair and the opening, for example, may be sized and configured to allow the chair to be moved and carried more easily. In particular, the opening is preferably formed in the upper portion of the backrest of the chair, but the opening could be formed in any suitable portion of the chair. The opening is preferably sized and configured to form a handle or gripping portion that allows a person to quickly and easily grasp the chair. This may make the chair easier to carry, transport, move, store, etc. The opening may also facilitate stacking of the chair and the opening may allow two or more chairs to be more easily transported or moved.

Still another aspect is a chair that may include a chair seat and/or back rest constructed from blow-molded plastic. The chair may include a frame that may be used to support the chair seat and back rest in the desired position. In addition, one or more crossbars may used to reinforce the chair. For example, one or more crossbars may be used to interconnect the legs. Advantageously, the crossbars may create a more rigid and sturdy chair, help position the legs in the correct locations, and prevent or reduce bending of the chair when a load is placed on the chair. One or more crossbars may also be used to support the chair seat. Significantly, the crossbars may create a more rigid and/or stronger chair seat. The crossbars may also help prevent the chair seat from flexing or bending when the chair is being used. Additionally, the crossbars may be nested within grooves formed in the bottom of the chair seat. The grooves formed in the bottom of the chair seat may also help increase the stiffness and/or rigidity of the chair seat.

Yet another aspect is a chair that may include a chair seat constructed from blow-molded plastic. The chair seat may include curved upper and lower surfaces, which may help increase the strength of the chair seat. The chair seat may also include upper and lower surfaces that are curved in two or more different directions. Advantageously, this may further increase the strength of the chair seat. For example, the upper surface of the chair seat may include a downwardly curved surface and the front surface of the chair seat may include a downwardly curved surface to increase the comfort of the user. In addition, the upper and lower surfaces of the chair seat may be separated by different distances, which may allow the upper and lower surfaces of the chair to be curved in two or more different directions. Desirably, the chair seat is sized and configured to comfortably support a person sitting in the chair, and the chair seat is capable of supporting relatively large static and dynamic loads.

Another aspect is a chair that may include a back rest with a front portion and a rear portion, the chair seat constructed from blow-molded plastic, and a chair seat with an upper portion and a lower portion, the chair seat constructed from blow-molded plastic. The chair seat is preferably disposed at an angle relative to the back rest. The chair may also include one or more legs that are sized and configured to support the chair seat and back rest above a surface; and the chair may include an opening formed in the backrest. The opening may extend through the backrest and the opening may be at least partially formed during the blow-molding process. Desirably, the opening forms at least a portion of a handle. The chair may also include a frame that is connected to at least a portion of the chair seat, and the chair may include at least one groove formed in the lower portion of the chair seat and a crossbar at least partially disposed within the groove. Advantageously, the groove and crossbar may be sized and configured to increase the strength of the chair seat. The chair seat and backrest may also include one or more curved surfaces, which may be sized and configured to increase the strength of the chair seat.

These and other aspects, features and advantages of the chair will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

Figure 2:
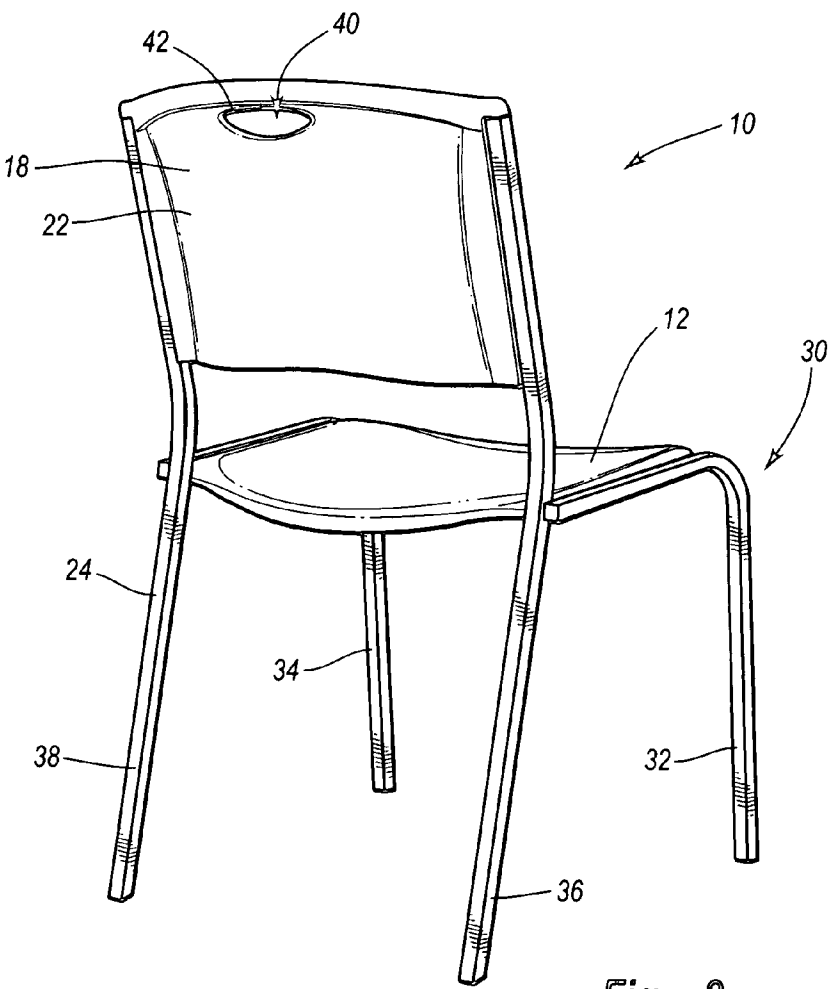
FIG. 2 is a rear perspective view of the chair shown in FIG. 1.
Figure 1:
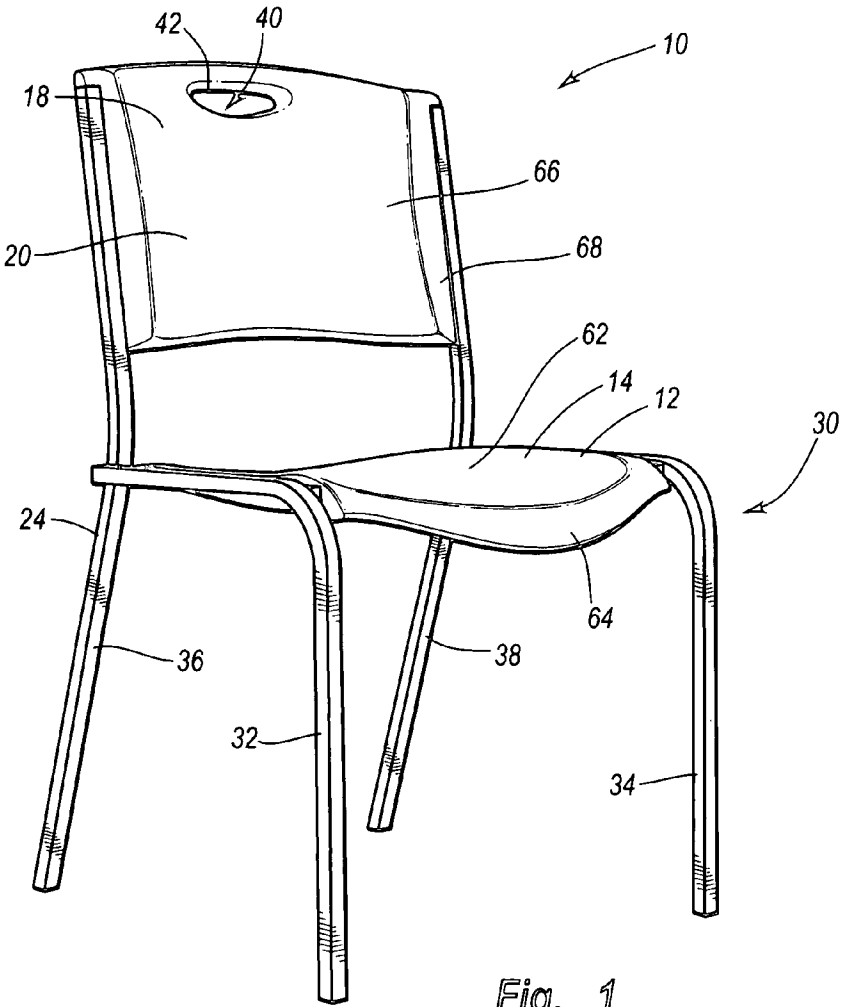
FIG. 1 is a front perspective view of a chair in accordance with an exemplary embodiment of the chair.
Figure 4:
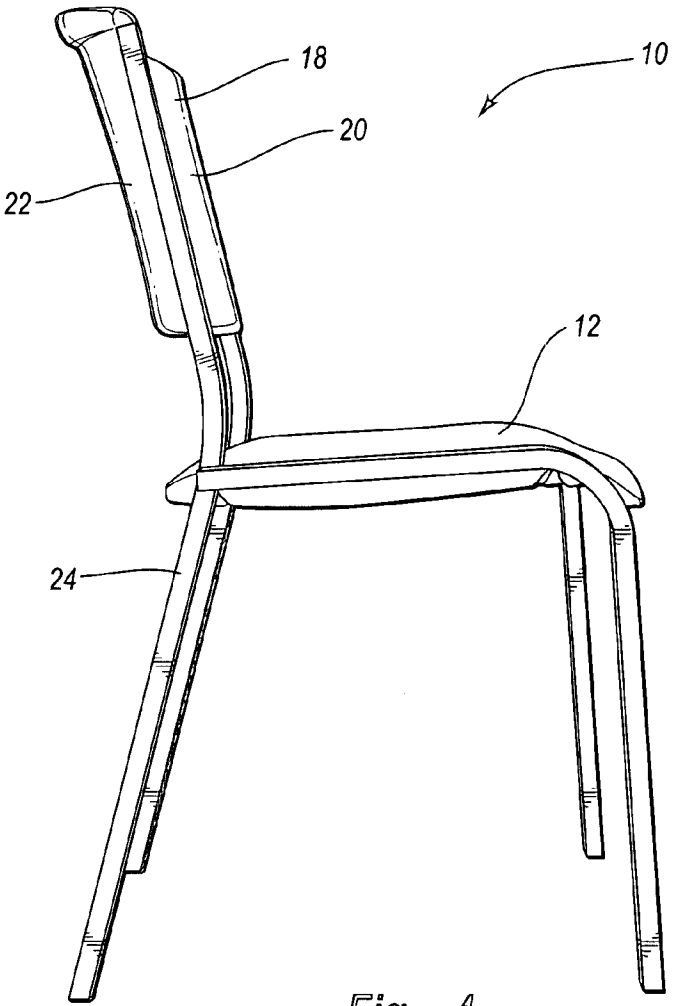
FIG. 4 is a left side view of the chair shown in FIG. 1, with the right side being a mirror image thereof.
Figure 3:
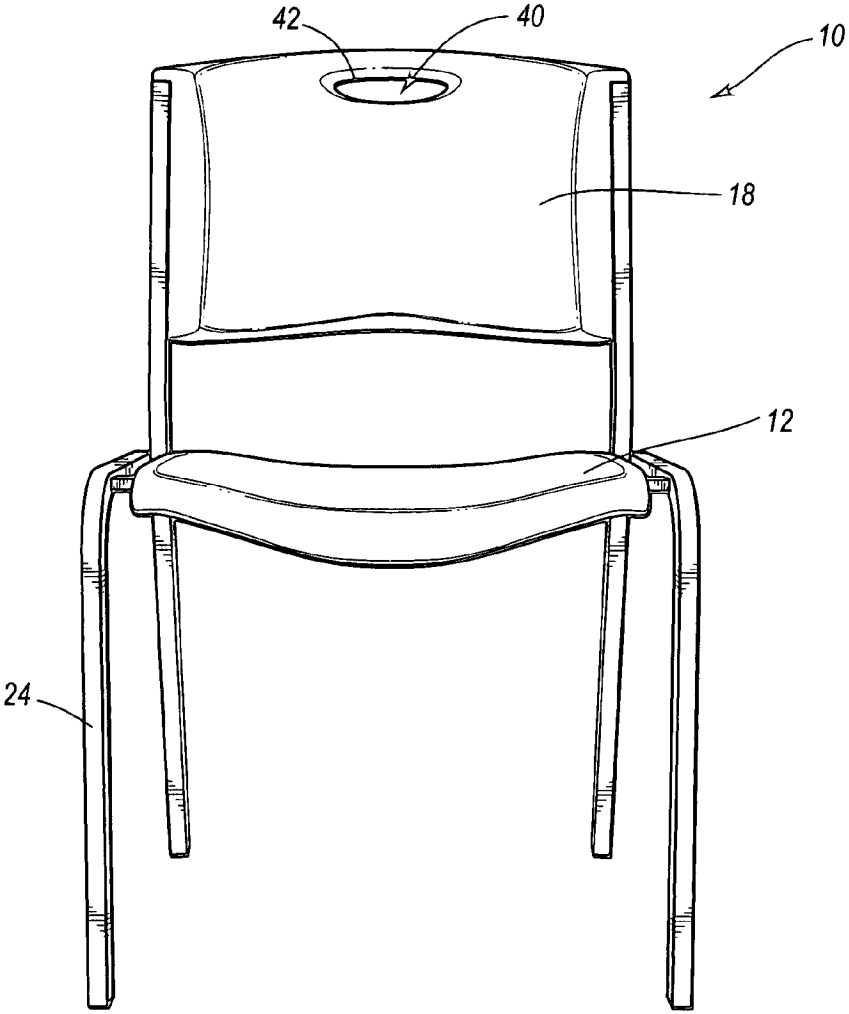
FIG. 3 is a front view of the chair shown in FIG. 1.
Figure 6:
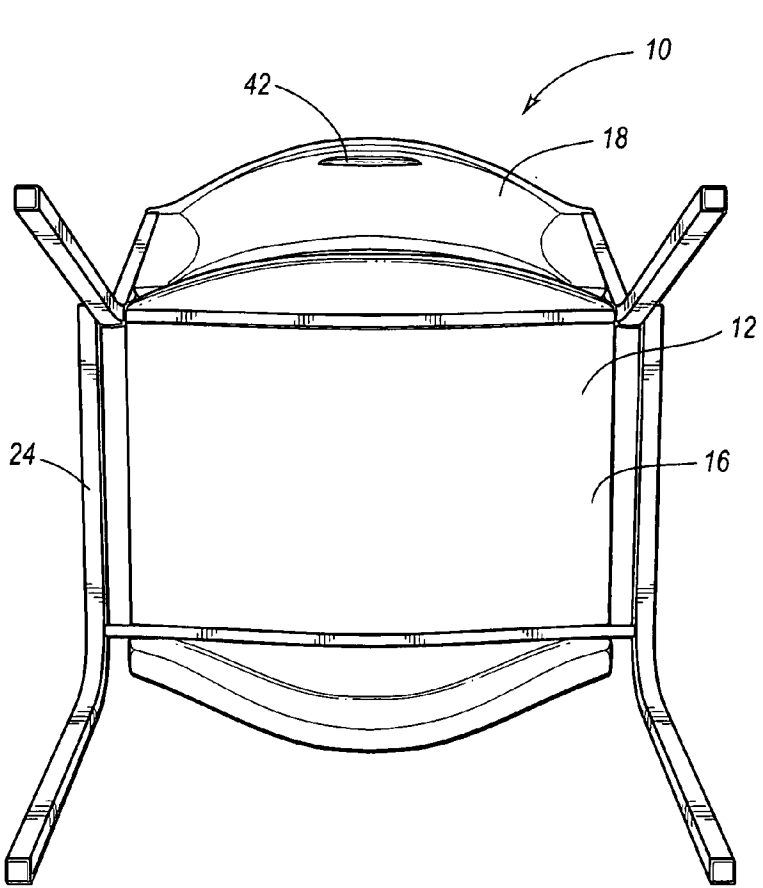
FIG. 6 is a bottom view of the chair shown in FIG. 1.
Figure 5:
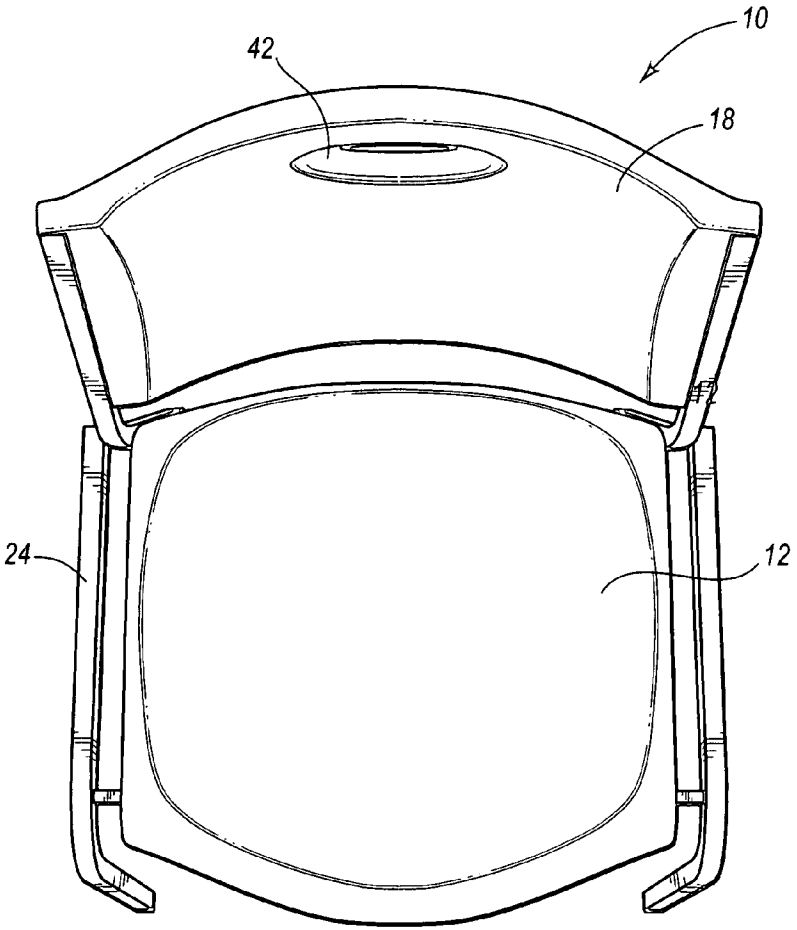
FIG. 5 is a top view of the chair shown in FIG. 1.

The present invention is generally directed towards a chair. The principles of the present invention, however, are not limited to a chair. It will be understood that, in light of the present disclosure, the invention disclosed herein can be successfully used in connection with other types of furniture such as benches, tables and the like.

Additionally, to assist in the description of the chair, words such as top, bottom, front, rear, right and left are used to describe the accompanying figures. It will be appreciated, however, that the chair can be located in a variety of desired positions—including various angles, sideways and even upside down. A detailed description of the chair now follows.

As shown in the accompanying figures, an exemplary embodiment of the chair 10 includes a seating portion 12 with an upper portion 14 and a lower portion 16. The chair 10 also includes a back rest 18 with a front portion 20 and a rear portion 22. A frame 24 may be used to support the seating portion 12 and the back rest 18 in the desired locations. For example, the frame 24 may include a right side portion and a left side portion that are connected to the seating portion 12 and the back rest 18. The frame 24 may also include or be attached to one or more legs 30 that may be used to support the chair seat 12 and back rest 18 above a surface such as a floor or the ground. As shown in the accompanying figures, the exemplary embodiment of the chair 10 may include a right front leg 32, a left front leg 34, a right rear leg 36 and a left rear leg 38. It will be appreciated that the chair 10 may include any suitable number and configuration of legs 30 depending, for example, upon the intended use and/or design of the chair.

The chair 10 is desirably sized and configured to allow a single person to use the chair at one time, but the chair could also be sized and configured to allow two or more persons to sit on the chair at one time. It will be understood that the chair 10 could have a variety of suitable shapes, sizes and configurations, depending, for example, upon the intended use of the chair. For example, the chair 10 could be larger or smaller, and it may have other suitable designs depending, for example, upon its intended appearance, aesthetics, and the like.

Figure 7B:
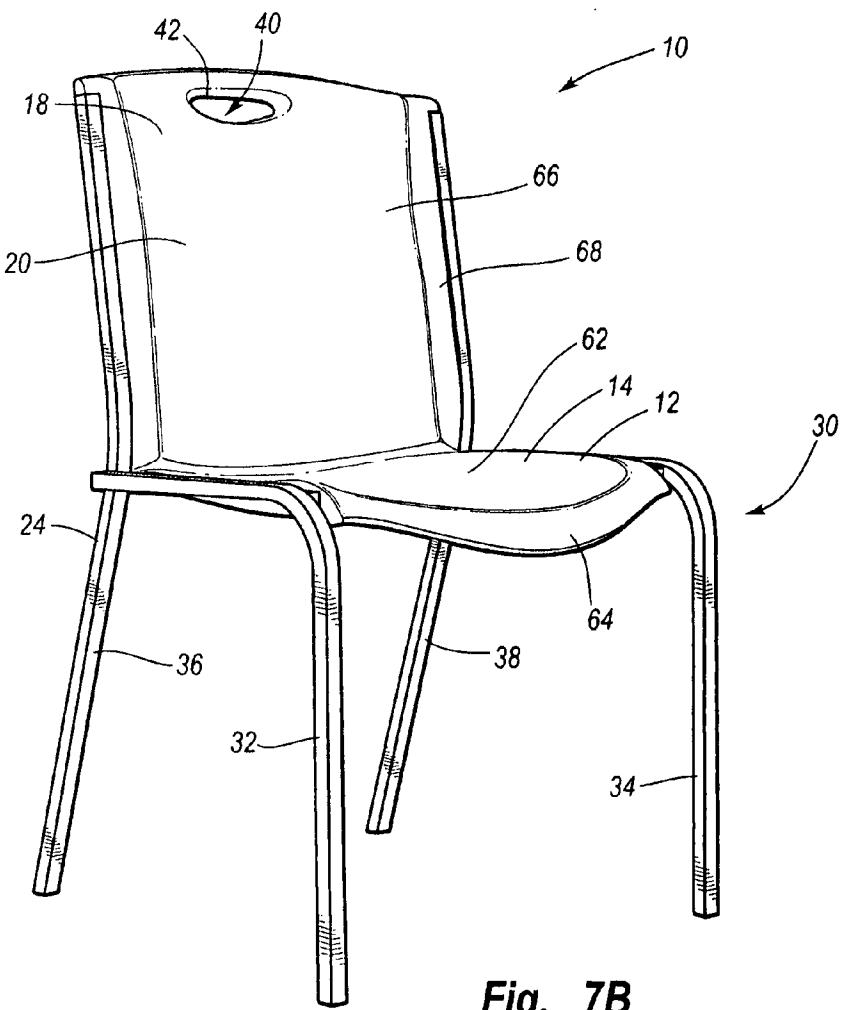
FIG. 7B is a front perspective view of a chair in accordance with another exemplary embodiment, illustrating a seating portion and a back rest as part of a unitary, one-piece structure.
Figure 7A:
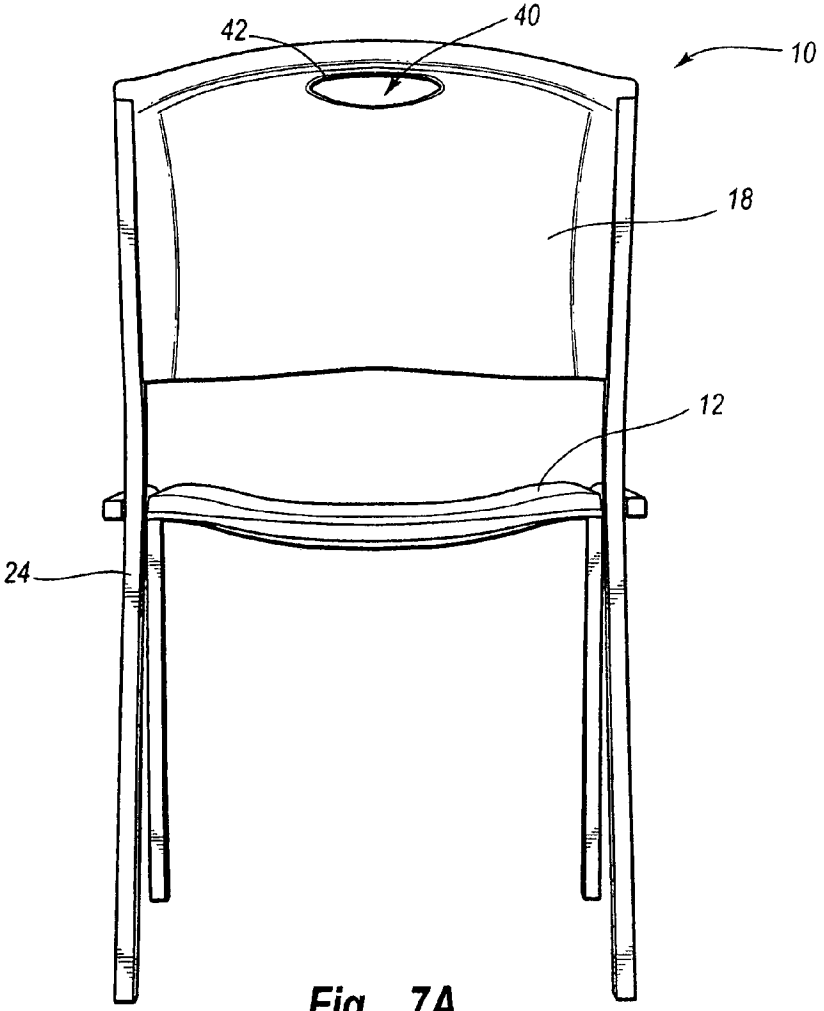
FIG. 7A is a rear view of the chair shown in FIG. 1.
Figure 9:
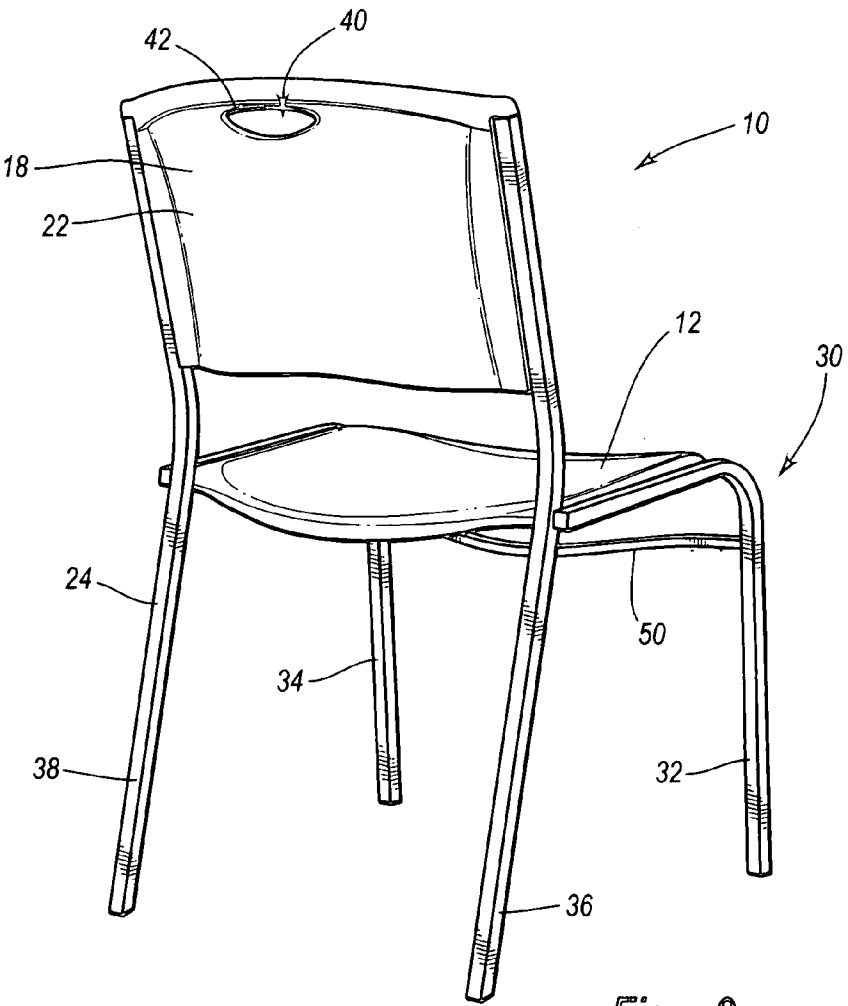
FIG. 9 is a rear perspective view of the chair shown in FIG. 8.
Figure 8:
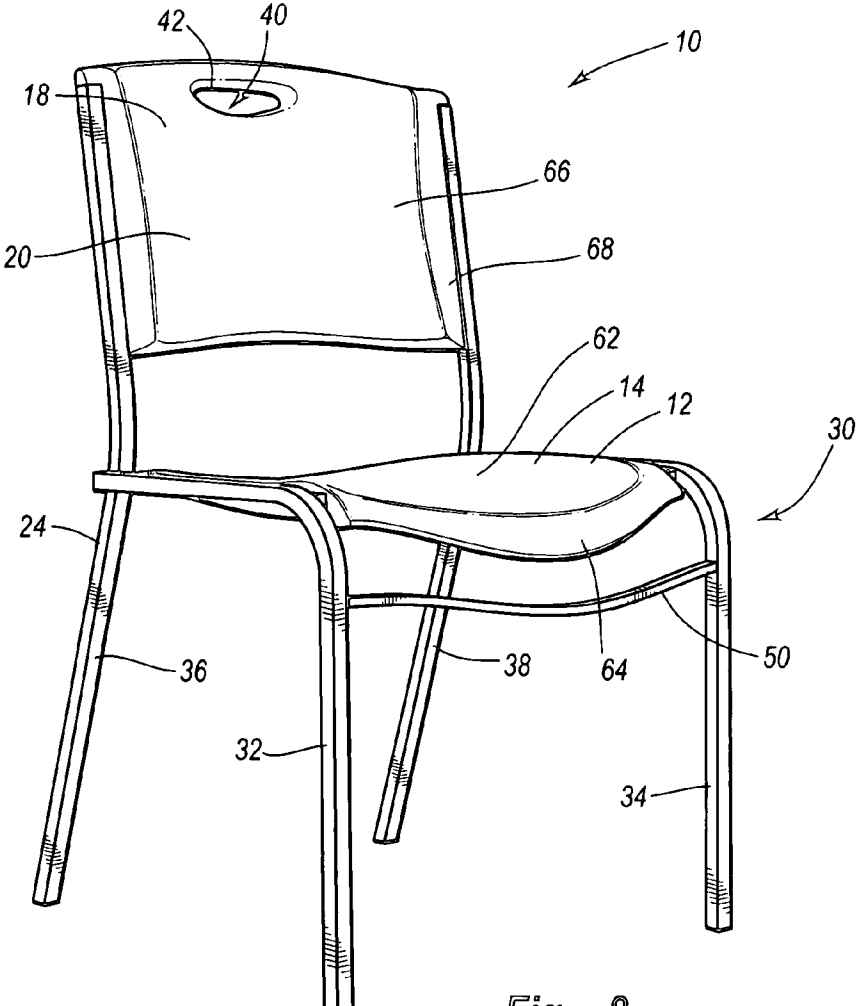
FIG. 8 is a front perspective view of a chair in accordance with another exemplary embodiment of the chair.
Figure 11:
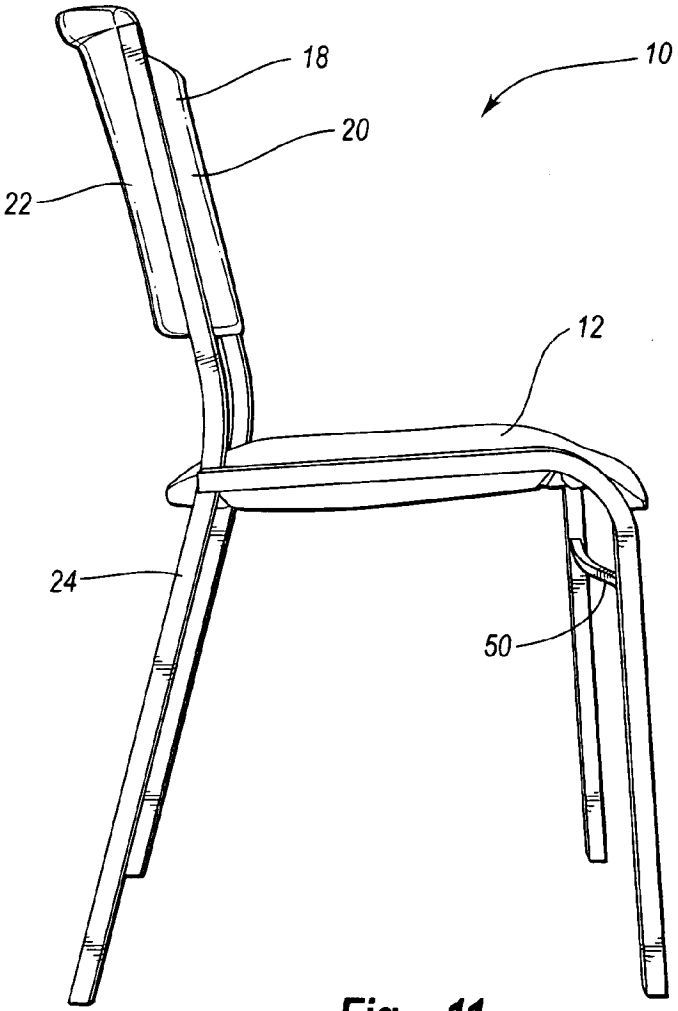
FIG. 11 is a left side view of the chair shown in FIG. 8, with the right side being a mirror image thereof.
Figure 10:
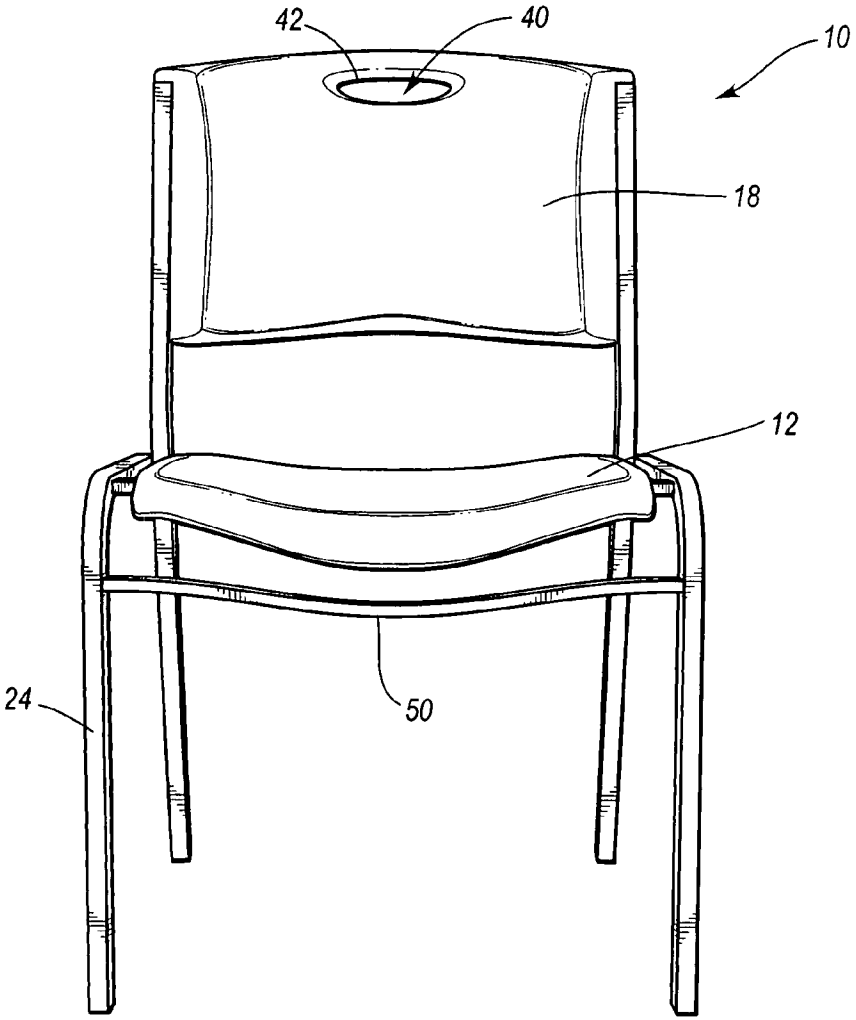
FIG. 10 is a front view of the chair shown in FIG. 8.

At least a portion of the chair 10 is desirably constructed from plastic and, in particular, from blow-molded plastic. For example, the back rest 18 and the seating portion 12 of the chair may be constructed from blow-molded plastic. One skilled in the art will appreciate that any suitable portions of the chair 10 can be constructed from plastic and, in fact, the entire chair may be constructed from plastic. In addition, one skilled in the art will appreciate that the seating portion 12 and the back rest 18 may be part of a unitary, one-piece structure, for instance, as shown in FIG. 7B. Thus, for example, the seating portion 12 and the back rest 18 may be constructed from blow-molded plastic and be part of a unitary, one-piece structure.

In greater detail, the chair seat 12 and back rest 18 are preferably constructed from plastic that is blow-molded into the desired shape and configuration. Advantageously, the blow-molded plastic chair seat 12 and back rest 18 may allow strong, durable and lightweight chairs 10 to be quickly and efficiently manufactured. It will be appreciated, however, that other suitable materials and processes may be used to construct the chair seat 12 and backrest 18. For example, the chair seat 12 and/or backrest 18 may also be constructed from wood, metal, etc. In addition, the chair seat 12 and backrest 18 may be formed by other suitable methods or processes such as injection molding, extrusion molding, vacuum forming, tumble molding, and the like. It will also be appreciated that the chair seat 12 and backrest 18 are not required to be manufactured by the same process. For example, the backrest 18 could be constructed from blow-molded plastic and the chair seat 12 could be formed from vacuum or injection molded plastic.

The chair frame 24 is desirably constructed from a relatively strong and sturdy material such as metal. In particular, the chair frame 24 may be constructed from hollow metal tubes that are bent or formed into the desired shapes and configurations. The tubular frame 24 may have a generally circular, square, rectangular, oval or other suitable cross-sectional configuration. Advantageously, the metal chair frame 24 may allow a strong, sturdy and lightweight chair 10 to be constructed. The frame 24, however, could be constructed from other materials with suitable characteristics and the frame may have other suitable shapes and configurations. In particular, the size and shape of the chair frame 24 could depend, for example, upon the intended use of the chair 10. It will be appreciated that the chair 10 could also be constructed without a frame 24, if desired.

As shown in the accompanying figures, the chair 10 may include one or more openings 40. In particular, the backrest 18 of the chair 10 desirably includes an opening 40 that is sized and configured to form a handle or grip 42. The opening 40 preferably extends completely through the backrest 18 of the chair 10, but the opening may extend through only a portion of the backrest. Advantageously, the handle 42 may allow the chair 10 to be easily moved and transported. In addition, the handle 42 may facilitate stacking of the chair 10 and it may be easier to hold and/or grip the chair. It will be appreciated that the handle 42 may be formed in any desired portion of the chair 10.

The handle 42 may also allow more than one chair 10 to be transported at one time. For example, the handles 42 may be generally aligned and an arm or other elongated member may be inserted through the openings. In particular, the handles 42 may be sized and configured to allow a dolly or other device to move a plurality of chairs 10 at one time. The handles 42 may also facilitate stacking and storing of the chairs 10, which may also allow a plurality of chairs to be quickly and easily transported at one time.

In addition, the handles 42 may facilitate use of the chairs 10 outdoors because the chairs may be quickly and easily moved into the desired positions. In addition, the handles 42 may allow the chairs 10 to be quickly and easily moved indoors and/or into a storage location. Further, the handles 42 may facilitate water drainage. Thus, for example, if the chairs 10 get wet, then the handles 42 may allow the water to drain more quickly. It will be appreciated that the chairs 10 could also include one or more openings 40 or handles 42. For example, a chair 10 could include an opening 40 that is sized and configured to allow water drainage and a handle 42 that is sized and configured to allow the chair to be easily moved and/or transported.

The openings 40 and/or handles 42 may allow the chairs 10 to be fastened or coupled together. For example, the openings 40 and/or handles 42 may allow the chairs 10 to be chained or fastened together to help prevent theft. The openings 40 and/or handles 42 may also allow the chairs 10 to be secured in a generally fixed location, if desired.

The openings 40 and/or handles 42 are preferably formed during the blow-molding process to allow the chairs 10 to be quickly and easily manufactured. The openings 40 and/or handles 42, for example, may be formed by creating a web that is then cut-out or removed after that portion of the chair 10 is constructed during a blow-molding process. The openings 40 and/or handles 42 could also be formed by having a portion of the two opposing surfaces abut, contact or engage. Thus, this portion of the chair 10 may have generally twice the wall thickness of the other portions of the chair. The portions of the opposing surfaces that abut, contact or engage could then be cut-out or removed. The openings 40 and/or handles 42 could be cut-out by hand or machine, if desired. One skilled in the art will appreciate that that openings 40 and/or handles 42 could also be drilled, punched, bored or otherwise formed in the chair.

The chair 10 may also include one or more crossbars. For example, as seen in FIGS. 8-14, a crossbar 50 may be used to connect one or more legs 30 of the chair 10. In particular, the crossbar 50 may connect the right front leg 32 and the left front leg 34, but it will be appreciated that the crossbar could connect any desired number or portion of the legs 30. For example, one or more crossbars may also be used to connect the rear legs 36, 38 and/or the right side legs 32, 36 and/or left side legs 34, 38. Advantageously, the crossbar 50 may be used to portions the legs 30 in the desired locations and the crossbar may be used to create a more rigid structure. Thus, the crossbar 50 may be used to create legs 30 that are less likely to bend or flex when a load or force is applied to the chair 10.

Figure 13:
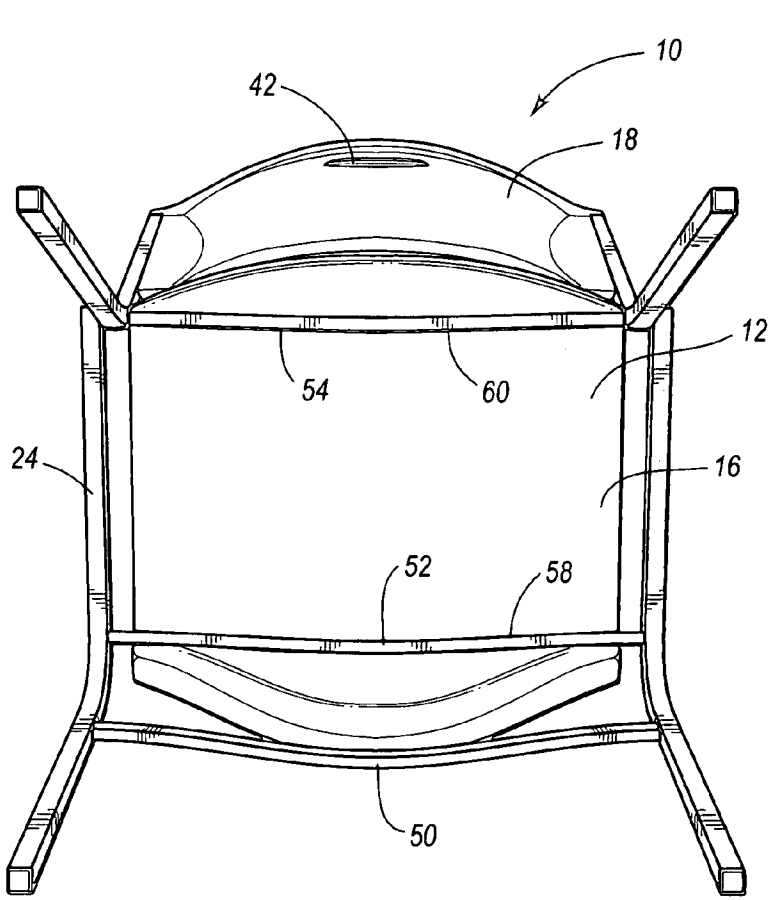
FIG. 13 is a bottom view of the chair shown in FIG. 8.
Figure 12:
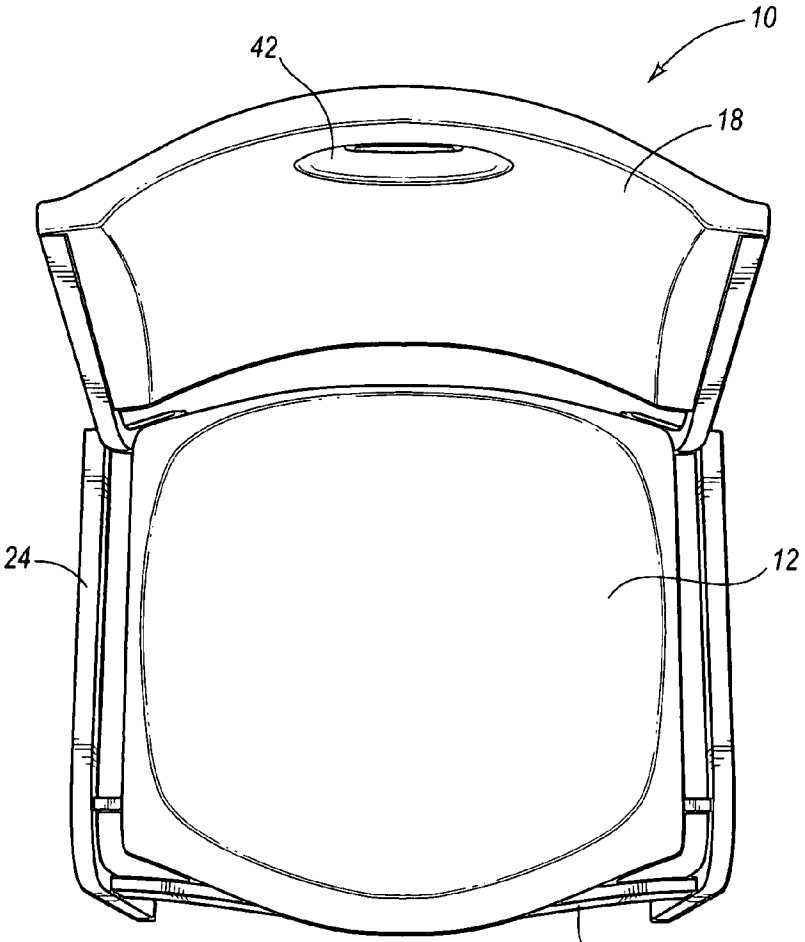
FIG. 12 is a top view of the chair shown in FIG. 8.
Figure 14:
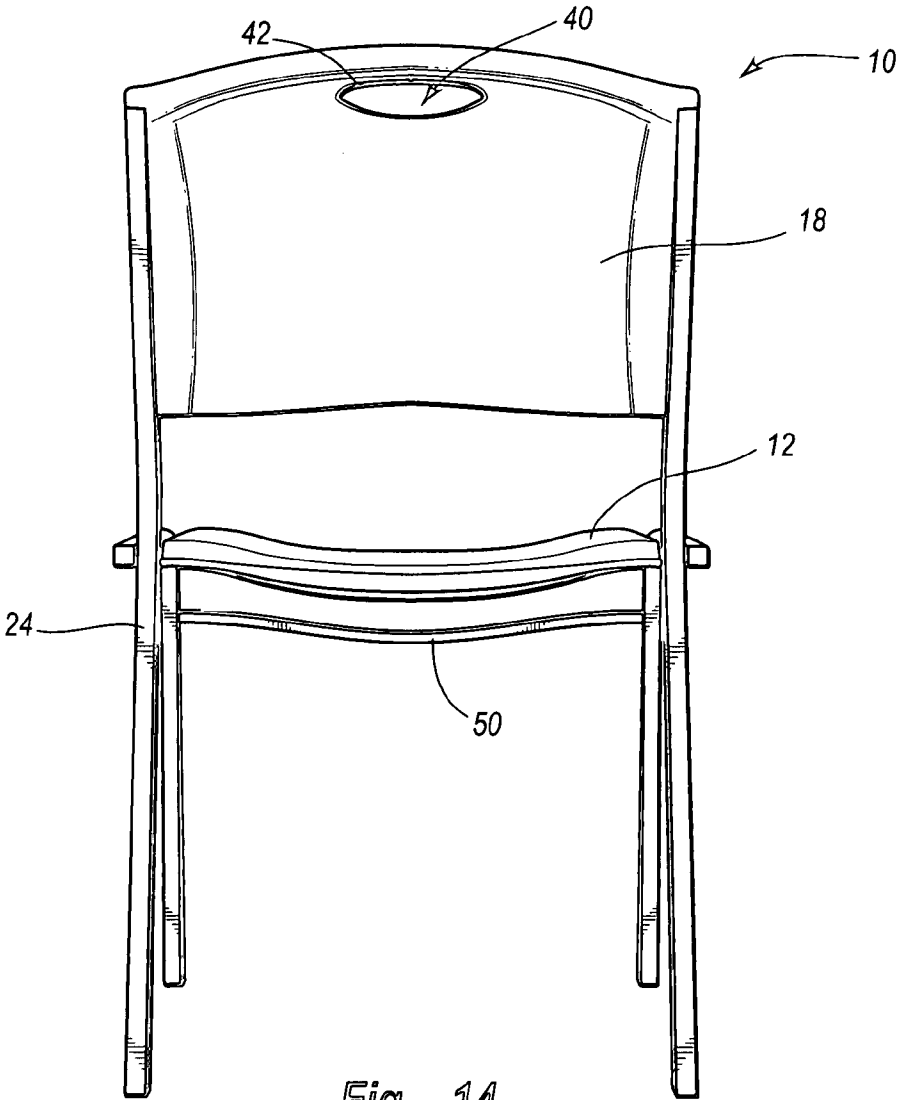
FIG. 14 is a rear view of the chair shown in FIG. 8.

Additionally, the chair 10 may include one or more crossbars that are sized and configured to support other desired portions of the chair. For example, the chair 10 may include one or more crossbars that are sized and configured to support the chair seat 12. In particular, as best seen in FIG. 13, the chair 10 may include crossbars 52, 54 that are sized and configured to support the chair seat 12. The crossbar 52 is preferably located proximate the front portion of the chair seat 12 and the crossbar 54 is preferably located proximate the rear portion of the chair seat. In addition, the crossbars 52, 54 preferably extend between the right and left sides of the chair 10, but the crossbars may be located in any desired positions and may have any desired shapes and configurations. Advantageously, the crossbars 52, 54 may help create a more rigid and secure chair 10. In addition, the crossbars 52, 54 may help correctly position the legs 30 and help prevent or eliminate undesirable bending or flexing of the chair 10. For example, the crossbars 52, 54 may help prevent or eliminate undesirably bending or flexing of the chair seat 12 and/or frame 24 when a load or force is applied to the chair 10.

The chair seat 12 preferably includes one or more grooves 58, 60 that extend across at least a portion of the lower portion 16 of the chair seat. Desirably, the grooves 58, 60 are integrally formed in the chair seat 12 during the manufacturing process. In particular, the grooves 58, 60 are preferably integrally formed in the lower portion 16 of the chair seat 12 during the blow-molding process, but the grooves could be formed at any desired time and by any suitable process. It will be appreciated that the grooves 58, 60 could have any desirable size and configuration, and the grooves could be formed in any desired portion of the chair 10. It will also be appreciated that the chair 10 does not require the grooves 58, 60.

As best seen in FIG. 13, the chair seat 12 preferably includes a first groove 58 and a second groove 60 that extend across at least a portion of the lower portion 16 of the chair seat. The grooves 58, 60 are preferably sized and configured to increase the stiffness and/or rigidity of the chair seat 12. In particular, the grooves 58, 60 preferably extend towards the upper portion 14 of the chair seat 12. Desirably, the inward portions of the grooves 58, 60 are spaced apart from the inner surface of the upper portion 14 of the chair seat 12 so that there is a gap or space between the grooves and the upper portion of the chair seat. This may allow the upper portion 14 of the chair seat 12 to flex or give slightly before it contacts the inward portions of the grooves 58, 60. This may also create a chair 10 that is comfortable for the user because the upper portion 14 of the chair seat 12 may bend or flex lightly, but then the grooves 58, 60 engage and support the upper portion of the chair seat. It will be appreciated that the grooves 58, 60 may also touch or abut the upper portion 14 of the chair seat 12, if desired. It will also be appreciated that the chair 10 may include any suitable number of grooves depending, for example, upon the intended use and/or design of the chair.

The crossbars 52, 54 are preferably at least partially disposed within the grooves 58, 60 respectively. Advantageously, nesting the crossbars 52, 54 within the grooves 58, 60 may increase the stiffness and rigidity of the chair seat 12. In particular, the grooves 58, 60 are preferably sized and configured to receive the crossbars 52, 54 so that at least a portion of the crossbars contact or abut at least a portion of the grooves. Thus, the crossbars 52, 54 may increase the strength and rigidity of the chair seat 12. While the grooves 58, 60 and crossbars 52, 54 are illustrated as being aligned in a generally parallel configuration and disposed near the front and rear portions of the chair seat 12, it will be appreciated that the grooves and crossbars may have other suitable shapes, sizes and configurations.

The chair 10 may also include a chair seat 12 and/or backrest 18 that are curved, for example, to increase the comfort of the user. For example, the chair seat 12 may include an upper portion 14 with a curved portion 62 that may facilitate a user sitting in the chair 10 and the curved portion may help create a chair seat that is stronger and/or more rigid. Preferably, the curved portion 62 is disposed proximate the center of the upper portion 14 of the chair seat 12.

In addition, the chair seat 12 may also include two or more curved surfaces, which may create a chair seat that is stronger than a chair seat with a generally flat or planar upper surface. For example, the upper portion 14 of the chair seat 12 may include a first downwardly curved portion 62 that is disposed towards the center of the chair seat and a second curved portion 64 that is disposed near or at the front of the chair seat. The curved portions 62, 64 are preferably sized and configured to increase the comfort of a person sitting in the chair 10. Advantageously, the curved portions 62, 64 may also increase the strength and rigidity of the chair seat 12.

The curved portions 62, 64 may also be used to create a chair seat 12 that is constructed from blow-molded plastic in which the upper and lower surfaces of the chair seat are separated by different distances. That is, the distance between the upper portion 14 and lower portion 16 of the chair seat 12 may vary because of the curved portions 62, 64. Thus, if the chair seat 12 includes one or more grooves 56, then the distance between the inner portions of the grooves and the opposing surface may vary. The distance between the upper portion 14 and the lower portion 16 of the chair seat 12, however, could be generally constant if desired.

Advantageously, the chair seat 12 may be stronger and more rigid than a conventional chair seat because of the crossbars 52, 54, the curved portions 62, 64, and/or the grooves 58, 60. In addition, these and other features may allow the chair seat 12 to support a larger static and/or dynamic load. This may also allow the chair 10 to withstand greater forces and impacts, which may increase the reliability, strength and usefulness of the chair.

Similarly, the backrest 18 may include one or more curved portions that are sized and configured to increase the comfort of the user. For example, the front portion 20 of the backrest 18 may include a curved portion 66 that may facilitate a user sitting in the chair 10 and the curved portion may help create a backrest that is stronger and/or more rigid. Preferably, the curved portion 66 is disposed proximate the center of the front portion 20 of the chair seat 12. In addition, the backrest 18 may a second curved portion 68. For example, the front portion 20 of the chair seat 12 may include a first inwardly curved portion 66 that is disposed towards the center of the backrest and a second curved portion 68 that is disposed near or at the edges of the backrest. The curved portions 66, 68 are preferably sized and configured to increase the comfort of a person sitting in the chair 10. Advantageously, the curved portions 66, 68 may also increase the strength and rigidity of the chair seat 12.

The curved portions 66, 68 may also be used to create a backrest 18 that is constructed from blow-molded plastic in which the front and rear portions 20, 22 of the backrest are separated by different distances. That is, the distance between the front portion 20 and rear portion 22 of the backrest 18 may vary because of the curved portions 66, 68. Thus, the distance between the front portion 20 and the rear portion 22 of the backrest 18 may vary. It will be appreciated, however, that the distance between the front portion 20 and the rear portion 22 of the backrest 18 could be generally constant if desired.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A chair comprising:

a back rest constructed from blow-molded plastic, the back rest including a right side, a left side, a front portion and a rear portion that is spaced apart from the front portion;

a chair seat constructed from blow-molded plastic, the chair seat including a right side, a left side, an upper portion and a lower portion that is spaced apart from the upper portion, the chair seat being disposed at an angle relative to the back rest;

a frame that is sized and configured to support the chair seat and back rest, the frame comprising:

an upper right side portion that is connected to the right side of the back rest;

an upper left side portion that is connected to the left side of the back rest, the back rest being at least substantially disposed between the upper right side portion and the upper left side portion of the frame;

a lower right side portion that is generally aligned with the right side of the chair seat; and a lower left side portion that is generally aligned with the left side of the chair seat, the chair seat being at least substantially disposed between the lower right portion and the lower left side portion of the frame;

a crossbar connected to the lower right side portion of the frame and the lower left side portion of the frame, the crossbar including an engaging portion that is sized and configured to allow flexing of the chair seat, the engaging portion of the crossbar being sized and configured to limit flexing of the chair seat when the engaging portion of the crossbar contacts the lower portion of the chair seat; and an opening formed in the back rest, the opening extending completely through the front portion of the back rest and the rear portion of the back rest, the opening at least partially defined by a wall disposed between the front portion of the back rest and the rear portion of the back rest, the wall being formed by a rearward extending and at least partially curved portion of the front portion of the back rest directly contacting and engaging an inwardly extending and at least partially curved portion of the rear portion of the back rest, the opening being at least partially formed during the blow-molding process, the opening including an upper portion that is generally aligned with an end of the upper right side portion of the frame and an end of the upper left side portion of the frame.

2. The chair as in claim 1, wherein the opening forms at least a portion of a handle.

3. The chair as in claim 1, wherein the wall disposed between the front portion of the back rest and the rear portion of the back rest includes a seam that is formed where the front portion of the back rest is joined to the rear portion of the back rest within the opening.

4. The chair as in claim 1, further comprising a groove formed in the lower portion of the chair seat, the engaging portion of the crossbar being at least partially disposed within the groove.

5. The chair as in claim 1, further comprising a first groove formed in the lower portion of the chair seat, a second groove formed in the lower portion of the chair seat and a second crossbar including an engaging portion;

wherein the engaging portion of the first crossbar is sized and configured to limit flexing of the chair seat when the engaging portion of the first crossbar contacts the first groove; and wherein the engaging portion of the second crossbar is sized and configured to allow flexing of the chair seat, the engaging portion of the second crossbar is sized and configured to limit flexing of the chair seat when the engaging portion of the second crossbar contacts the second groove.

6. The chair as in claim 5, wherein the first groove, second groove, first crossbar and second crossbar are sized and configured to increase the strength of the chair seat.

7. The chair as in claim 1, wherein the chair seat and the back rest are integrally formed as part of a unitary, one-piece construction.

8. The chair as in claim 1, further comprising a first curved portion formed in the upper portion of the blow-molded chair seat and a second curved portion formed in the upper portion of the blow-molded chair seat, the first and second curved portions being sized and configured to increase the strength of the chair seat.

9. The chair as in claim 1, wherein the upper portion of the blow-molded chair seat and the lower portion of the blow-molded chair seat are separated by a generally varying distance.

10. The chair as in claim 1, further comprising a first curved portion formed in the front portion of the blow-molded back rest and a second curved portion formed in the front portion of the blow-molded back rest, the first and second curved portions being sized and configured to increase the strength of the back rest.

11. The chair as in claim 1, wherein the front portion of the blow-molded back rest and the rear portion of the blow-molded back rest are separated by a generally varying distance.

12. The chair as in claim 1, wherein the frame includes a first front leg and a second front leg, the chair seat being generally positioned between the first front leg and the second front leg, and the chair seat being spaced apart from the first front leg and the second front leg.

13. A chair comprising:

a chair seat constructed from blow-molded plastic, the chair seat including a right side, a left side, an upper portion and a lower portion that is at least partially spaced apart from the upper portion;

a groove formed in the lower portion of the chair seat during the blow-molding process;

a back rest constructed from blow-molded plastic, the back rest including a right side, a left side, a front portion and a rear portion that is at least partially spaced apart from the front portion;

a frame connected to the chair seat and back rest, the frame including a right side portion that is connected to the right side of the back rest and is generally aligned with the right side of the chair seat, the frame including a left side portion that is connected to the left side of the back rest and is generally aligned with the left side of the chair seat, the back rest and the chair seat being at least substantially disposed between the right side portion and the left side portion of the frame;

an opening extending completely through the front portion of the back rest and the rear portion of the back rest, the opening being at least partially defined by a surface disposed between the front portion of the back rest and the rear portion of the back rest, the opening being formed by a rearward extending and at least partially curved portion of the front portion of the back rest directly contacting and engaging an inwardly extending and at least partially curved portion of the rear portion of the back rest, the opening including an upper portion that is generally aligned with an end of the right side portion of the frame and an end of the left side portion of the frame; and a crossbar including an upper portion that is at least partially disposed within the groove in the lower portion of the chair seat to allow flexing of the chair seat, the upper portion of the crossbar being sized and configured to limit flexing of the chair seat when the upper portion of the crossbar engages the groove the lower portion of the chair seat.

14. The chair as in claim 13, wherein the surface that defines at least a portion of the opening includes a seam that connects the front portion of the back rest to the rear portion of the back rest.

15. The chair as in claim 13, wherein the surface that defines at least a portion of the opening is at least partially formed by a wall that is disposed between the front portion of the back rest and the rear portion of the back rest.

* * * * *

UNITED STATES PATENT AND TRADEMARK OFFICE

CERTIFICATE OF CORRECTION

PATENT NO. : 7,452,035 B2
APPLICATION NO. : 10/980950
DATED : November 18, 2008
INVENTOR(S) : Astle et al.

It is certified that error appears in the above-identified patent and that said Letters Patent is hereby corrected as shown below:

Title Page
Primary Examiner, change "Sarah B" to --Sarah B.--

Column 1
Line 43, change "chair" to --chairs--
Line 45, change "Table" to --Tables--
Line 47, change "chair" to --chairs--

Column 3
Line 67, change "limits" to --limit--

Column 6
Line 43, change "portions the" to --connect portions of the--

Column 8
Line 1, change "56" to --58, 60--
Line 21, change "may a" to --may have a--
Claim 1, line 66, change "right" to --right side--

Column 10
Claim 13, line 54, change "groove the" to --groove in the--

Signed and Sealed this

Eighteenth Day of August, 2009

David J. Kappos

David J. Kappos
*Director of the United States Patent and Trademark Office*